US007339779B2

(12) United States Patent
Chen et al.

(10) Patent No.: US 7,339,779 B2
(45) Date of Patent: Mar. 4, 2008

(54) PIEZOELECTRIC ANION GENERATOR CONTROLED BY INTEGRATED CIRCUIT

(75) Inventors: Yaoqiang Chen, Xi An (CN); Zhe Yang, Xi An (CN); Peng Quan, Xi An (CN); Zhijun Hou, Xi An (CN)

(73) Assignee: Xi'an Kong Hong New Materials Sci-tech Co., Ltd., Xi An (CN)

( * ) Notice: Subject to any disclaimer, the term of this patent is extended or adjusted under 35 U.S.C. 154(b) by 93 days.

(21) Appl. No.: 11/226,294

(22) Filed: Sep. 15, 2005

(65) Prior Publication Data

US 2006/0077615 A1 Apr. 13, 2006

(30) Foreign Application Priority Data

Oct. 9, 2004 (CN) ..... 2004 1 0073135

(51) Int. Cl.
*H01T 23/00* (2006.01)

(52) U.S. Cl. ..... 361/231; 361/230

(58) Field of Classification Search ..... 361/230; 315/209 PZ

See application file for complete search history.

(56) References Cited

U.S. PATENT DOCUMENTS 4,757,422 A * 7/1988 Bossard et al. ..... 361/231
4,846,178 A * 7/1989 Fuxue et al. ..... 607/2
2003/0160572 A1* 8/2003 Wells et al. ..... 315/224

* cited by examiner

*Primary Examiner*—Michael Sherry
*Assistant Examiner*—Scott Bauer
(74) *Attorney, Agent, or Firm*—Birch, Stewart, Kolasch & Birch, LLP

(57) ABSTRACT

A piezoelectric anion generator controlled by an integrated circuit IC, which includes an oscillation circuit, a frequency following-up circuit, an power amplification circuit, a step-up circuit, a voltage-doubling circuit, an ion discharging pin, a negative feedback voltage-stabilizing circuit and a bleeder circuit. Due to using the integrated circuit IC controlling circuit, it can provide the AC exciting voltage at the certain frequency to the piezoelectric ceramic transformer and has the functions of regulating the exciting voltage and the frequency following up. The piezoelectric ceramic transformer is used as the main AC step-up element to realize the AC high voltage output. After the voltage-doubling commutation the DC high voltage can be obtained, and the anion-discharging pin connected to it generates the high voltage electrical field, and then the gas is ionized to give out a lot of anions.

11 Claims, 2 Drawing Sheets

PIEZOELECTRIC ANION GENERATOR CONTROLED BY INTEGRATED CIRCUIT

BACKGROUND

1. Field of the Invention

The present invention relates to a miniature anion generator in the electric technical field. More particularly, the present invention relates to a piezoelectric anion generator controlled by an integrated circuit IC.

2. Description of Related Art

It is common knowledge that the traditional anion generator usually uses DC/AC converting, and steps up by the wire-wound transformer, and then achieves a needful DC voltage by the voltage-doubling commutating. A discharging pin generates a high voltage electrical field, and then the gas is ionized to give out the anions. It described above requires that the wire-wound transformer have a very high step-up ratio, and it requires that the dielectric strength of the primary winding and the secondary winding of the transformer and the dielectric strength between the turns of the secondary winding are very strong. So it has some shortcomings such as the complex processing technique, the biggish volume, the higher cost, and the high failure ratio in use. And it sometimes has some catastrophic failures such as the breakdown and the short between the turns in the transformer, and even the burning.

SUMMARY

In view of the reasons above, an object of the present invention is to provide a piezoelectric anion generator controlled by an integrated circuit IC, which don't require the short-circuit protection and has some advantages such as the high step-up ratio, the simple insulation, the security, the stableness, the small electromagnetic interference and the small volume.

To achieve the above object, the present invention provides the following technical project: a piezoelectric anion generator controlled by an integrated circuit IC, which includes an oscillation circuit, a frequency following-up circuit, an power amplification circuit, a step-up circuit, a voltage-doubling commutating circuit, an ion discharging pin, a negative feedback voltage-stabilizing circuit and a bleeder circuit. The characters and the remarkable advantages of the present invention are that the internal circuit of the integrated circuit IC is connected to the periphery circuit so as to form the oscillation circuit, and the internal circuit of the integrated circuit is connected to the periphery circuit so as to form the frequency following-up circuit, and the integrated circuit is connected to the power amplification circuit, and the power amplification circuit is connected to the step-up circuit, and the step-up circuit provides the negative feedback signals and is connected to the integrated circuit via the negative feedback voltage-stabilizing circuit and synchronously is connected to the voltage-doubling commutating circuit, and the voltage-doubling commutating circuit is connected to the ion discharging pin and the bleeder circuit, and the bleeder circuit is connected to the anion protective grid.

The said oscillation circuit is the RC oscillator composed of the integrated circuit IC and the adjustable RC in the periphery circuit, and the said adjustable RC is composed of the adjustable resistor $R_T$ and the adjustable capacitor $C_T$.

The said frequency following-up circuit is the frequency following-up circuit composed of the IC and the adjustable RC in the periphery circuit.

The said power amplification circuit is the power amplification circuit composed of the MOS field effect power triode.

The said step-up circuit is composed of the piezoelectric ceramic transformer circuit.

The said voltage-doubling commutating circuit is composed of the high-voltage diode and the high-voltage capacitor.

The said step-up circuit is composed of the piezoelectric ceramic transformer and the multistage voltage-doubling circuit.

The said negative feedback voltage-stabilizing circuit is composed of the negative feedback circuit and the IC so as to obtain the stable DC high-voltage output.

The said ion-discharging pin is composed of the discharging needle or the discharging brush.

The said bleeder circuit is composed of the bleeder resistor and the diode.

The present invention has the following advantages from the above description:

1. In the present invention it is controlled by the integrated circuit IC so that the oscillation circuit and the frequency following-up circuit are simpler, and the frequency modulation is more convenient, and then it can adapt to the changes of the environment temperature better and can work more reliably.

2. In the present invention the step-up circuit uses the piezoelectric ceramic transformer to generate the AC high voltage and has high step-up ratio, small volume, simple insulation, the security, the stableness and the small electromagnetic interference compared with the traditional wire-wound transformer.

3. In the present invention it has some advantages such as simple circuit, no short-circuit protection, the security, the stableness and the high reliability, and it can use the batteries to supply the power and is formed to be the portable anion generator.

4. In the present invention it can be used as the high voltage power supply equipment and can supply more than several thousands volts DC high voltage when it is connected to the other loads and not to the anion discharging pin, and its polarity can be positive or negative.

DETAILED DESCRIPTION

The figures are the embodiments of the present invention.

To make the present invention known more clearly, the content of the present invention will be further detailed described accompanying with the figures.

Figure 1:
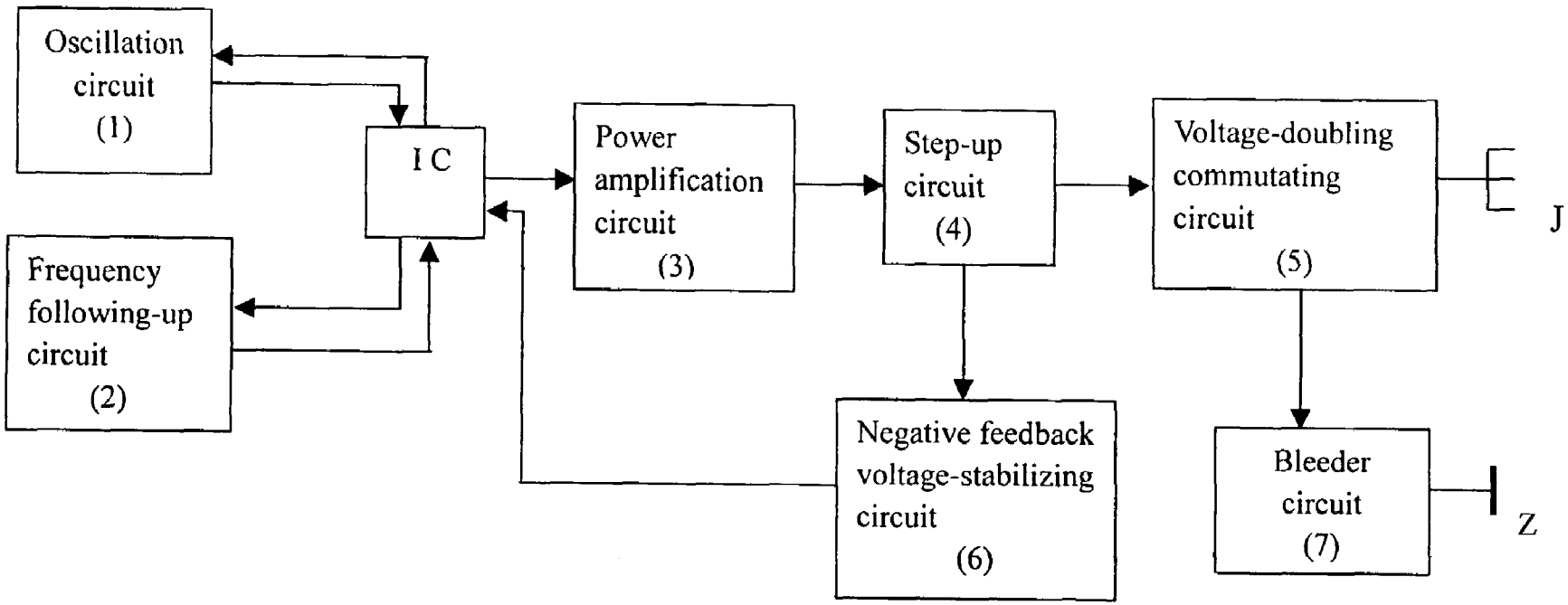
FIG. 1 is a structural schematic block diagram according to the present invention.

Referring to FIG. 1, it is mainly composed of seven portions according to the present invention, wherein the integrated circuit IC is connected to the periphery circuit so as to form the oscillation circuit 1, and the integrated circuit IC is connected to the periphery circuit so as to form the frequency following-up circuit 2, and the integrated circuit IC is connected to the power amplification circuit 3, and the power amplification circuit 3 is connected to the step-up circuit 4, and the step-up circuit 4 provides the negative feedback signals and is connected to the integrated circuit IC via the negative feedback voltage-stabilizing circuit 6 and synchronously is connected to the voltage-doubling commutating circuit 5, and the voltage-doubling commutating circuit 5 is connected to the ion discharging pin J and the bleeder circuit 7, and the bleeder circuit 7 is connected to the anion protective grid Z. The power supply voltage can be provided by the external dry batteries. It can be a portable one.

Figure 2:
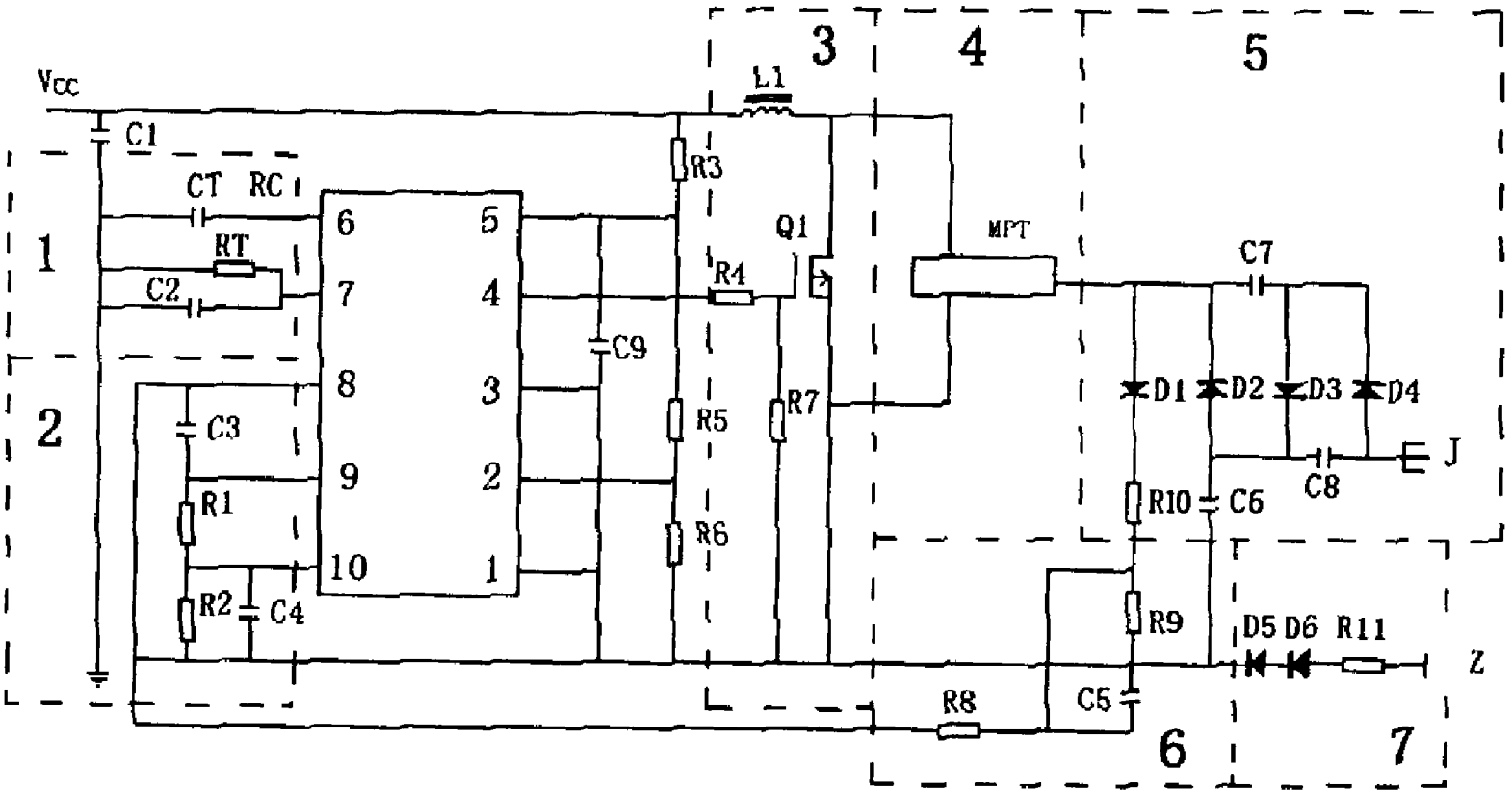
FIG. 2 is a circuit schematic diagram of FIG. 1.

The connection of the circuits and the functional principle thereof are further described accompanying with the FIG. 2 as follows:

The said oscillation circuit 1 is composed of the integrated circuit IC internal circuit and the $R_T$ and the $C_T$ in the periphery circuit, and regulating the parameters of the resistor $R_T$ and the capacitor $C_T$ can change the hunting frequency of the oscillation circuit 1.

The said frequency following-up circuit 2 is composed of the integrated circuit IC internal circuit and the resistors R1, R2 and the capacitors C1, C2 in the periphery circuit, and regulating the parameters of the R1, R2, C1 and C2 can fulfill the requirement of the frequency following-up.

The said power amplification circuit is the power amplifier composed of the MOS field effect power triode Q1 and the inductor L1 and the resistors R4, R7, and the R7 provides the bias voltage, and the R4 can limit the current, and the L1 is the energy storage element, and it can realize the pulse power amplification to excite the piezoelectric ceramic transformer.

The said piezoelectric ceramic transformer step-up circuit 4 is composed of the piezoelectric ceramic transformer MPT and has the high step-up ratio.

The said voltage-doubling commutating circuit 5 is composed of the diodes D2, D3, D4 and the capacitors C7, C8, and it can realize the voltage doubling commutating high-voltage output connected to the anion discharging pin J so as to generate the high voltage electrical field, and then the gas is ionized to give out a lot of anions.

The said negative feedback voltage-stabilizing circuit 6 is composed of integrated circuit IC internal circuit and the D1, R8, R9, R10 and the C5 in the periphery circuit.

The said bleeder circuit 7 is composed of the bleeder resistor R11 and D5, D6.

When the certain DC voltage is supplied from the outside (when the supplying voltage is too low it can use the DC/DC converting to properly improve the voltage so as to make sure that the piezoelectric anion generator controlled by the integrated circuit IC is in the range of the natural working voltage), the working voltage is supplied to the integrated circuit IC via the R3 and the switching voltage is supplied to the integrated circuit IC via the R5 so that the integrated circuit IC is in the range of the natural working voltage. And the $R_T$ or the $C_T$ in the oscillation circuit 1 are regulated according to the resonance frequency of the piezoelectric ceramic transformer to make the hunting frequency same as the resonance frequency of the piezoelectric ceramic transformer. And the values of the parameters R1, R2, C1, C2 in the frequency following-up circuit 2 are regulated well to make the hunting frequency following automatically the changes of the resonance frequency of the piezoelectric ceramic transformer in order to make the piezoelectric ceramic transformer work in the preparative resonance state all the time. The C9 is the power filter capacitor. The integrated circuit IC output the certain pulse voltage amplified later through the power amplifier 3 and then provides the exciting voltage to the piezoelectric transformer through the energy storage L1, and the piezoelectric ceramic transformer step-up circuit 4 steps up, and then the voltage-doubling commutating circuit 5 can realize the two or more times voltage doubling commutating output so as to obtain more than several thousands volts DC high voltage output. The anion-discharging pin J connected with it generates the high voltage electrical field, and then the gas is ionized to give out a lot of anions. The parameter of the R10 in the negative feedback voltage-stabilizing circuit 6 may be regulated at the same time to realize the better negative feedback controlling and the stable DC high voltage output in order that the anion-discharging pin J effectively and stably generates the high voltage electrical field, and then the gas is ionized to give out a lot of anions.

When the anion generator is wrong, the integrated circuit IC can detect automatically the working state of the circuit and can control it to make the anion generator reconverted to the normal working state. The bleeder circuit 7 is composed of the R11, D5 and D6. One end of the bleeder resistor R11 is connected to the protect grid Z in the shell of the anion generator, increasing the diffusion to the outside of the shell of the anions.

The above description is only the embodiment of the present invention, and not limiting the protecting range of the present invention, and each equivalent modification produced from the present invention should be involved in the protecting range of the present invention.

The invention claimed is:

1. A piezoelectric anion generator controlled by an integrated circuit IC, which includes an oscillation circuit, a frequency following-up circuit, a power amplification circuit, a step-up circuit, a voltage-doubling circuit, an ion discharging pin (J), a negative feedback voltage-stabilizing circuit and a bleeder circuit, characterized such that: the integrated circuit (IC) is connected to a periphery circuit so as to form the oscillation circuit, and the integrated circuit (IC) is connected to the periphery circuit so as to form the frequency following-up circuit, and the integrated circuit (IC) is connected to the power amplification circuit, and the power amplification circuit is connected to the step-up circuit, and the step-up circuit provides negative feedback signals and is connected to the integrated circuit (IC) via the negative feedback voltage-stabilizing circuit and synchronously is connected to the voltage-doubling circuit, and the voltage-doubling circuit is connected to the ion discharging pin (J) and the bleeder circuit, and the bleeder circuit is connected to an anion protective grid (z);

the oscillation circuit is composed of the integrated circuit (IC) and an adjustable resistor ($R_T$) and an adjustable capacitor ($C_T$) in the periphery circuit;

the frequency following-up circuit is composed of the integrated circuit (IC) and resistors R1 and R2 and capacitors C3 and C4 in the periphery circuit;

the power amplification circuit is composed of an MOS field effect power triode (Q1) and an inductor (L1);

the step-up circuit is composed of a piezoelectric ceramic transformer circuit;

the voltage-doubling circuit is composed of a high-voltage diode and a high-voltage capacitor;

the negative feedback voltage-stabilizing circuit is composed of a negative feedback circuit and the integrated circuit (IC);

the bleeder circuit is composed of a bleeder resistor and a diode;

the ion-discharging pin (J) is composed of a discharging needle or a discharging brush.

2. The piezoelectric anion generator controlled by an integrated circuit IC as claimed in claim 1, wherein the hunting frequency can be regulated.

3. The piezoelectric anion generator controlled by an integrated circuit IC as claimed in claim 1, wherein the following-up frequency can be regulated.

4. The piezoelectric anion generator controlled by an integrated circuit IC as claimed in claim 1, wherein when the anion generator operates abnormally, the integrated circuit automatically detects the abnormal operation and controls the anion generator to return to a normal working state.

5. The piezoelectric anion generator controlled by an integrated circuit IC as claimed in claim 1, wherein the step-up circuit is composed of a slice piezoelectric ceramic transformer and provides an AC high voltage output.

6. The piezoelectric anion generator controlled by an integrated circuit IC as claimed in claim 1, wherein the voltage-doubling circuit is composed of high-voltage diodes and high-voltage capacitors and provides a voltage-doubling DC high voltage output.

7. The piezoelectric anion generator controlled by an integrated circuit IC as claimed in claim 6, wherein the ion discharging pin connected to the voltage-doubling DC high voltage circuit generates a high voltage electrical field, and ionizes a gas to produce anions.

8. The piezoelectric anion generator controlled by an integrated circuit IC as claimed in claim 1, wherein the negative feedback voltage-stabilizing circuit is composed of the integrated circuit and a diode, resistors, and a capacitor in the periphery circuit and stabilizes the DC high voltage output.

9. The piezoelectric anion generator controlled by an integrated circuit IC as claimed in claim 5, wherein the piezoelectric ceramic transformer realizes independently an AC high voltage output; and the voltage-doubling circuit realizes independently a DC high voltage output; the polarity thereof is positive or negative.

10. The piezoelectric anion generator controlled by an integrated circuit IC as claimed in claim 1, wherein one end of the bleeder resistor of the bleeder circuit is connected to the protect grid (z) in the anion generator, to increase of the diffusion to the outside of the shell of the anions.

11. The piezoelectric anion generator controlled by an integrated circuit IC as claimed in claim 6, wherein the piezoelectric ceramic transformer realizes independently a AC high voltage output; and the voltage-doubling circuit realizes independently a DC high voltage output; the polarity thereof is positive or negative.

* * * * *